US009461424B2

(12) United States Patent
Kao et al.

(10) Patent No.: US 9,461,424 B2
(45) Date of Patent: Oct. 4, 2016

(54) ELECTRICAL RECEPTACLE CONNECTOR AND ELECTRICAL PLUG CONNECTOR

(71) Applicant: ADVANCED-CONNECTEK INC., New Taipei (TW)

(72) Inventors: Ya-Fen Kao, New Taipei (TW); Yu-Lun Tsai, New Taipei (TW); Pin-Yuan Hou, New Taipei (TW); Wen-Yu Wang, New Taipei (TW); Wen-Hsien Tsai, New Taipei (TW); Alan Robert MacDougall, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/692,396

(22) Filed: Apr. 21, 2015

(65) Prior Publication Data

US 2015/0303623 A1 Oct. 22, 2015

(30) Foreign Application Priority Data

Apr. 21, 2014 (TW) ..... 103214012 U

(51) Int. Cl.
*H01R 13/648* (2006.01)
*H01R 24/60* (2011.01)
*H01R 13/6583* (2011.01)

(52) U.S. Cl.
CPC ..... *H01R 24/60* (2013.01); *H01R 13/6583* (2013.01)

(58) Field of Classification Search
CPC ..... H01R 4/64; H01R 4/646; H01R 23/688; H01R 13/65802; H01R 13/658; H01R 23/6873; H01R 23/7073
USPC ..... 439/92, 98, 101, 108, 607.01, 607.04, 439/607.08–607.11, 607.35, 607.4, 607.53, 439/660
See application file for complete search history.

(56) References Cited

U.S. PATENT DOCUMENTS

| | | | | |
|---|---|---|---|---|
| 7,572,071 | B1 * | 8/2009 | Wu | G02B 6/3817 385/101 |
| 8,262,420 | B2 * | 9/2012 | Xiong | H01R 13/65802 439/607.23 |
| 8,353,722 | B1 * | 1/2013 | Lan | H01R 13/6581 439/607.35 |
| 8,827,742 | B2 * | 9/2014 | Wang | H01R 24/68 439/569 |
| 8,851,906 | B2 * | 10/2014 | Wu | H01R 13/6581 439/607.45 |
| 8,961,235 | B2 * | 2/2015 | Little | H01R 13/64 439/374 |
| 9,209,573 | B1 * | 12/2015 | Chen | H01R 13/6581 |
| 9,281,643 | B1 * | 3/2016 | Tseng | H01R 13/518 |
| 9,306,337 | B2 * | 4/2016 | Yu | H01R 24/60 |
| 9,312,644 | B2 * | 4/2016 | Kao | H01R 13/6591 |
| 9,318,856 | B2 * | 4/2016 | MacDougall et al. | H01R 13/6581 |
| 9,356,406 | B2 * | 5/2016 | Yen | H01R 24/60 |

* cited by examiner

*Primary Examiner* — Thanh Tam Le
(74) *Attorney, Agent, or Firm* — Muncy, Geissler, Olds & Lowe, P.C.

(57) ABSTRACT

An electrical receptacle connector, provided to connect with an electrical plug connector, includes a metal shell, an insulation housing and a conductive piece. The conductive piece is disposed at a tongue portion of the insulation housing and includes a contact portion, two laterally soldering portions and an abutting portion. The contact portion is disposed at a rear contact region of the tongue portion, the two laterally soldering portions are respectively extending from two sides of the contact portion, and the abutting portion is extending from the contact portion to attach on a base portion of the insulation ho thus abutting against an inner wall of the metal shell.

19 Claims, 14 Drawing Sheets

ELECTRICAL RECEPTACLE CONNECTOR AND ELECTRICAL PLUG CONNECTOR

CROSS-REFERENCES TO RELATED APPLICATIONS

This non-provisional application claims priority under 35 U.S.C. §119(a) on Patent Application No. 103214012 filed in Taiwan, R.O.C. on Apr. 21, 2014, the entire contents of which are hereby incorporated by reference.

FIELD OF THE INVENTION

The present invention relates to an electrical connector, and particularly to an electrical receptacle connector and an electrical plug connector for connected therewith.

BACKGROUND

Generally, an electrical connector interface adopts a Universal Serial Bus (USB) which is widely used by common consumers due to a plug-and-play characteristic of the USB, and nowadays a USB 2.0 transmission specification is developed to a USB 3.0 transmission specification with a faster transmission speed.

Since the existing electronic product is designed to be downsized and when a USB electrical receptacle connector and other surrounding electronic elements on the electronic product are adjacent to each other and used for transmitting a signal, the shield signal of the USB electrical receptacle connector and the protection on preventing Electromagnetic Interference (EMI) must be properly designed so as to avoid signal interference with the other electronic elements. For example, a high-frequency electrical signal is connected in series with a USB electrical plug connector which is connected with the USB electrical receptacle connector via the USB electrical receptacle connector, or signal interference is generated among a plurality of adjacent USB electrical receptacle connectors so that the operation accuracy of the electrical product provided with the USB electrical receptacle connector or an external electrical product connected with the USB electrical plug connector is reduced due to the signal interference.

Furthermore, application convenience, such as low insertion force and high withdrawal force during plugging, should be considered when the USB electrical receptacle connector and the USB electrical plug connector are connected. A structure for preventing the EMI cannot have effects of low insertion force and high withdrawal force. Therefore, how to solve the problem of a known structure is an issue that persons skilled in the relevant field should think.

SUMMARY OF THE INVENTION

In view of the above-mentioned problems, the present invention provides an electrical receptacle connector. The electrical receptacle connector includes a metal shell, an insulation housing, a plurality of upper-row plate terminals, a plurality of lower-row plate terminals and at least one conductive piece; the metal shell includes a receptacle cavity and a plug-in opening communicating with each other; the insulation housing is received in the receptacle cavity and includes a base portion and a tongue portion; the tongue portion is extending from one side of the base portion and includes a front contact region and a rear contact region; the front contact region is adjacent to the plug-in opening, and the rear contact region is adjacent to the base portion; the tongue portion includes an upper surface and a lower surface; the upper-row plate terminals include a plurality of upper-row plate signal terminals, at least one upper-row plate power-supply terminal and at least one upper-row plate ground terminal; each of the upper-row plate terminals is disposed at the base portion and the tongue portion, and located at the upper surface; the lower-row plate terminals include a plurality of lower-row plate signal terminals, at least one lower-row plate power-supply terminal and at least one lower-row plate ground terminal; each of the lower-row plate terminals is disposed at the base portion and the tongue portion, and located at the lower surface; the at least one conductive piece is disposed at the tongue portion and includes a contact portion, two laterally soldering portions and an abutting portion; the contact portion is disposed at the rear contact region; the two laterally soldering portions are respectively extending from two sides of the contact portion, and the abutting portion is extending from the contact portion to attach on the base portion thus abutting against an inner wall of the metal shell.

The present invention also provides an electrical plug connector provided to plug into the electrical receptacle connector. The electrical plug connector includes a metal shell, an insulation housing, a plurality of upper-row elastic terminals, a plurality of lower-row elastic terminals and a plurality of abutting pieces, where the metal shell includes a plug cavity and a connection opening; the insulation housing is received in the plug cavity and includes an upper portion, a lower portion and a terminal groove, the terminal groove is disposed between the upper and lower portions; the upper and lower portions include a plurality of through grooves adjacent to the connection opening; the upper-row elastic terminals include a plurality of upper-row elastic signal terminals, at least one upper-row elastic power-supply terminal and at least one upper-row elastic ground terminal; each of the upper-row elastic terminals is disposed at the insulation housing and located at a lower surface of the upper portion; the lower-row elastic terminals include a plurality of lower-row elastic signal terminals, at least one lower-row elastic power-supply terminal and at least one lower-row elastic ground terminal; each of the lower-row elastic terminals is disposed at the insulation housing and located at an upper surface of the lower portion; each of the upper-row elastic terminals respectively corresponds to each of the lower-row elastic terminals; the abutting pieces are disposed at the upper portion and the lower portion and connected to the metal shell, each of the abutting pieces includes a body portion and at least one bent contacts, the body portion is received in the through groove, and the bent contact is extending from the body portion and extends toward the terminal groove from the through groove.

In conclusion, since the abutting pieces of the electrical plug connector is connected with the conductive piece of the electrical receptacle connector, effective conducting and grounding are achieved between the metal shell of the electrical plug connector and the metal shell of the electrical receptacle connector due to the connection of the abutting pieces and the conductive piece, and EMI can be further reduced. Furthermore, with the structural configuration of first cutout areas or second cutout areas of the abutting pieces, the abutting resistance for connecting the electrical plug connector with the electrical receptacle connector can be reduced, thereby allowing the electrical plug connector can be connected with the electrical receptacle connector with low insertion force and high withdrawal force.

Detailed description of the characteristics and the advantages of the present invention is shown in the following embodiments, the technical content and the implementation of the present invention should be readily apparent to any person skilled in the art from the detailed description, and the purposes and the advantages of the present invention should be readily understood by any person skilled in the art with reference to content, claims and drawings in the disclosure.

BRIEF DESCRIPTION OF THE DRAWINGS

The disclosure will become more fully understood from the detailed description given herein below for illustration only, and thus are not limitative of the disclosure, and wherein.

DETAILED DESCRIPTION

Figure 1:
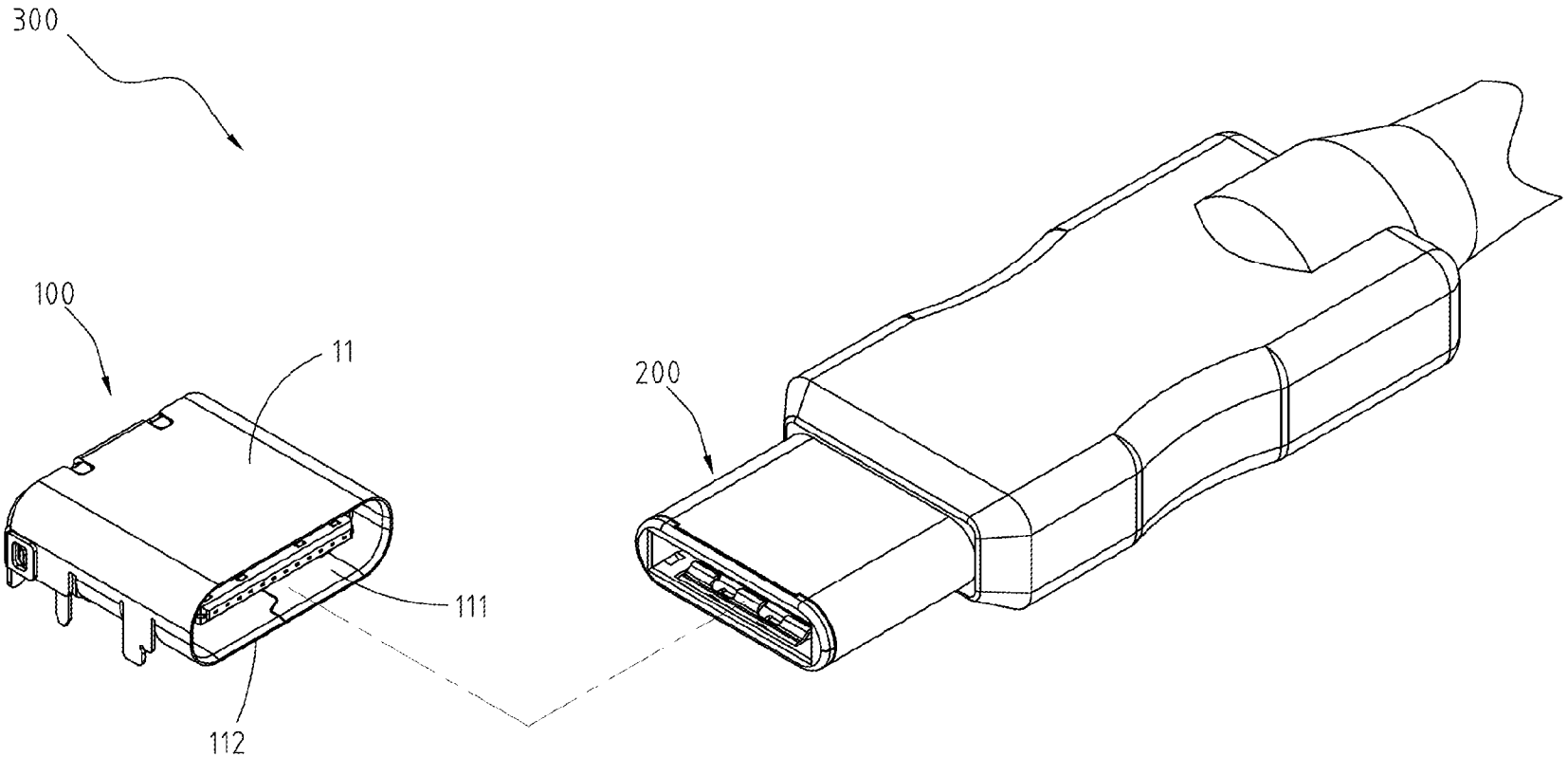
FIG. 1 is an exploded perspective view of an electrical connector assembly according to the present invention.
Figure 2:
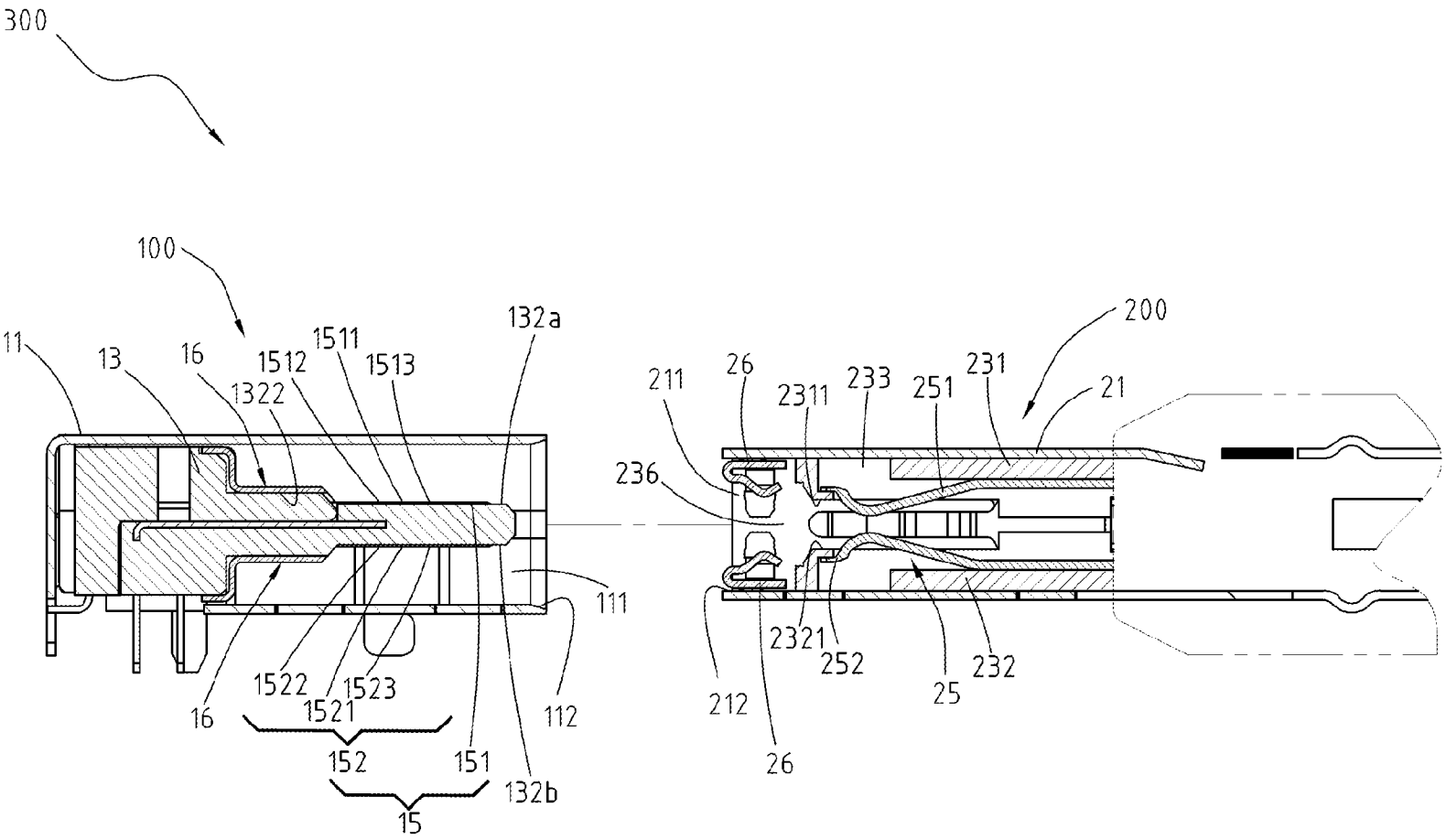
FIG. 2 is a cross-sectional view for showing the electrical connector assembly according to the present invention is to be assembled.
Figure 3:
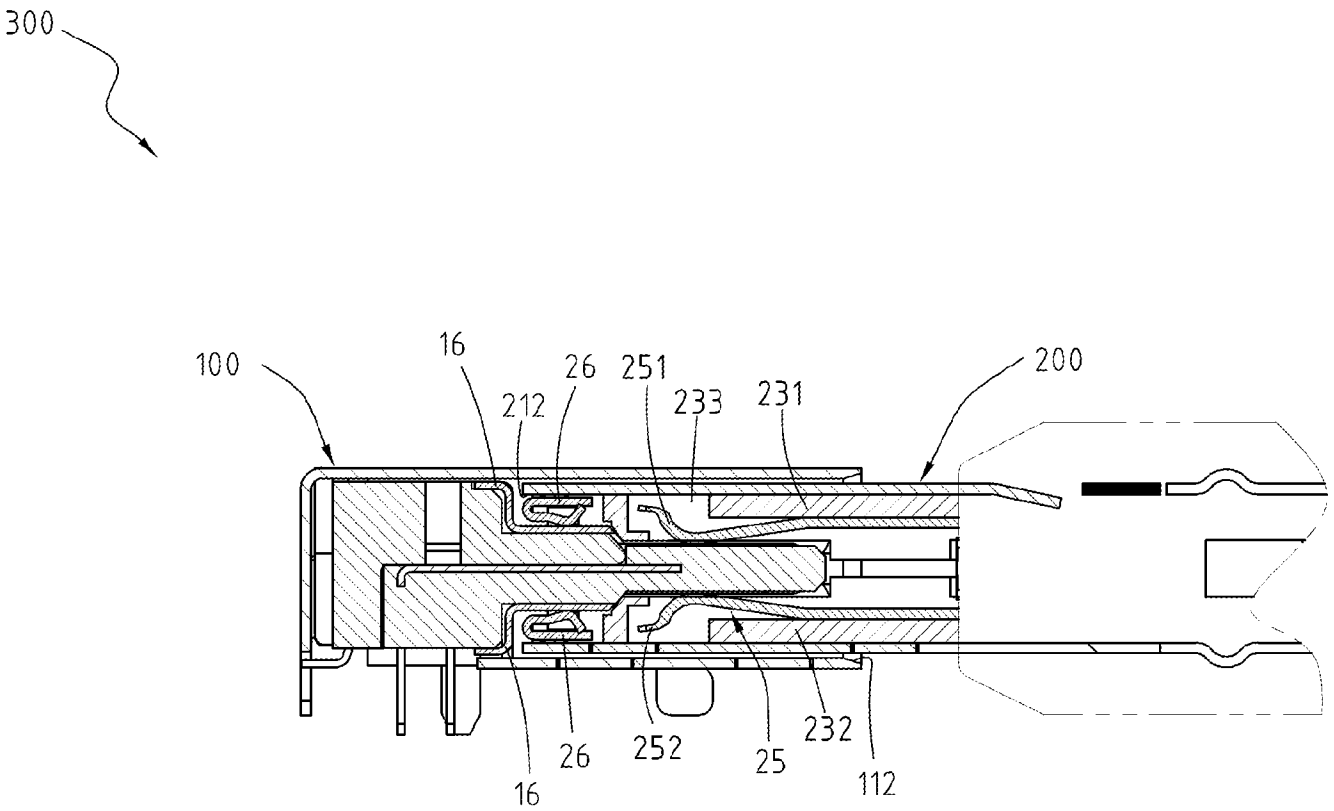
FIG. 3 is a lateral view of the electrical connector assembly according to the present invention.

Referring to FIGS. 1, 2 and 3, the embodiment of an electrical connector assembly 300 according to the present invention is shown. FIG. 1 is an exploded view, FIG. 2 is an exploded side view, and FIG. 3 is a lateral view of the electrical connector assembly 300. The electrical connector assembly 300 according to the present invention mainly includes an electrical receptacle connector 100 and an electrical plug connector 200.

Figure 4:
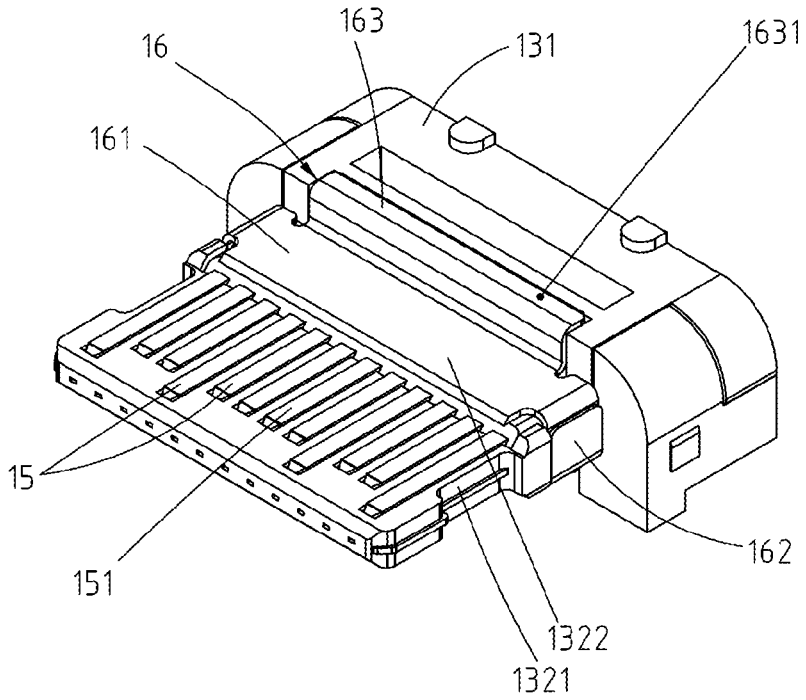
FIG. 4 is a perspective view of an electrical receptacle connector according to the present invention.
Figure 5:
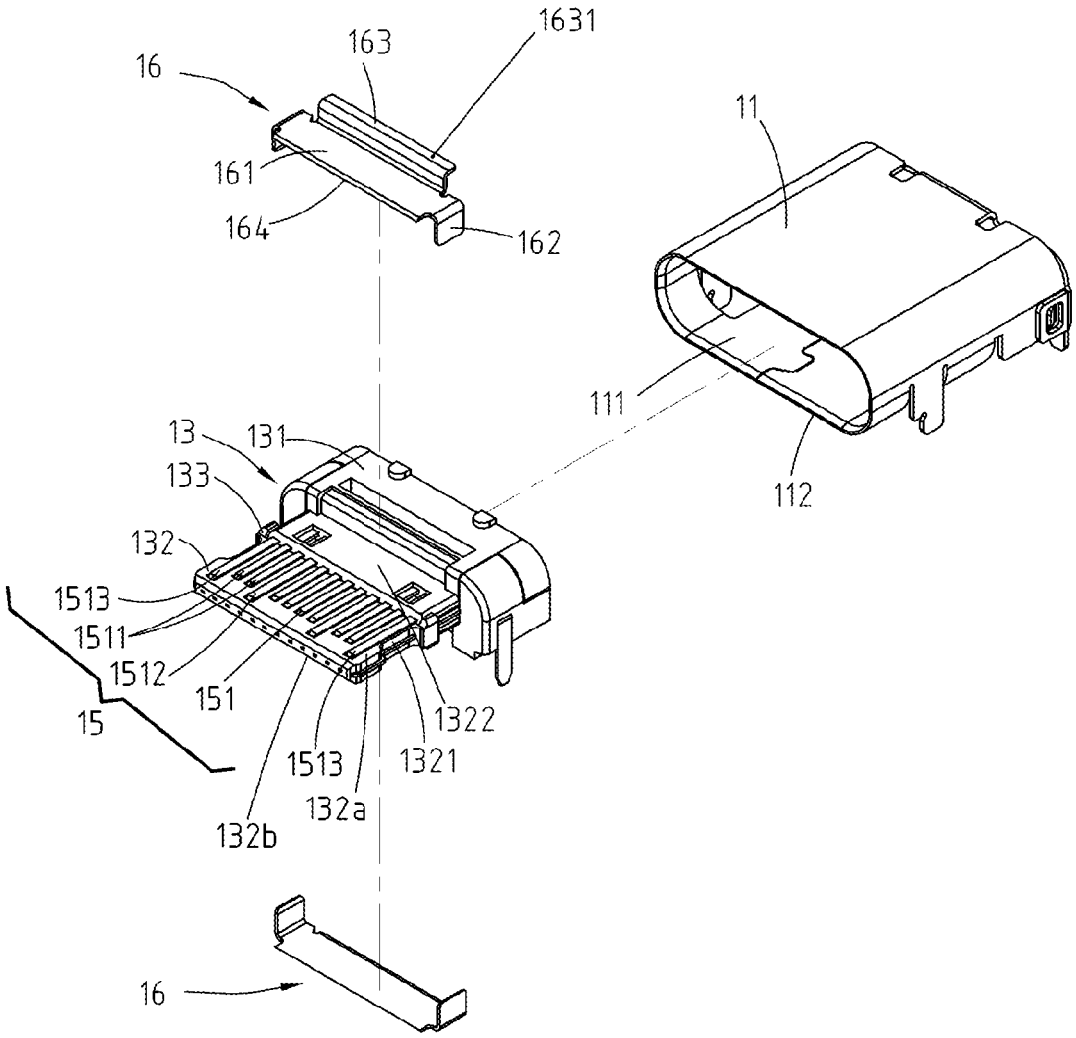
FIG. 5 is an exploded view of the electrical receptacle connector according to the present invention.

Referring to FIGS. 4 and 5, particularly, FIG. 4 clearly shows that a plurality of conductive pieces 16 is disposed at an insulation housing 13 while a metal shell 11 is eliminated from the electrical receptacle connector 100. The electrical receptacle connector 100 described herein is in accordance with the specification of a type-C USB connection interface and mainly includes a metal shell 11, an insulation housing 13, a plurality of receptacle terminals 15 and at least one conductive piece 16.

The metal shell 11 is a hollow shell, a receptacle cavity 111 is defined in the metal shell 11; in the embodiment, the metal shell 11 can be formed by a unitary or multi-piece member. Furthermore, the metal shell 11 defines a plug-in opening 112 in the shape of, for example, oblong or rectangular and communicates with the receptacle cavity 111 of the metal shell 11.

The insulation housing 13 is received in the receptacle cavity 111 and mainly includes a base portion 131 and a tongue portion 132; here, the base portion 131 and the tongue portion 132 are formed by insert molding technique; the tongue portion 132 is extending from one side of the base portion 131 and is provided with a front contact region 1321 and a rear contact region 1322; the front contact region 1321 is adjacent to the plug-in opening 112, and the rear contact region 1322 is adjacent to the base portion 131. Moreover, the tongue portion 132 includes an upper surface 132*a* and a lower surface 132*b*.

The receptacle terminals 15 are disposed at the base portion 131 and the tongue portion 132. The receptacle terminals 15 include a plurality of upper-row plate terminals 151 and a plurality of lower-row plate terminals 152.

Please refer to FIG. 2, FIG. 3, FIG. 4 and FIG. 5; in which the upper-row plate terminals 151 are disposed at the base portion 131 and the tongue portion 132. The upper-row plate terminals 151 include a plurality of upper-row plate signal terminals 1511, at least one upper-row plate power-supply terminal 1512 and at least one upper-row plate ground terminal 1513. Each of the upper-row plate terminals 151 is disposed at the base portion 131 and the tongue portion 132, and located at the upper surface 132*a*. with a front view of the upper-row plate terminals 151, the upper-row plate terminals 151 include, from left to right, an upper-row plate ground terminal 1513 (Gnd), a first pair of differential signal terminals (TX1+−), a second pair of differential signal terminals (D+−), and a third pair of differential signal terminals (RX2+−) of the upper-row plate signal terminals 1511, upper-row plate power-supply terminals 1512 (Power/VBUS) between the three pairs of differential signal terminals, a retain terminal (RFU), (the retain terminal and a configuration channel 1 (CC1) are respectively arranged between the upper-row plate power-supply terminals 1512 and the second pair of differential signal terminals of the upper-row plate signal terminals 1511), and another upper-row plate ground terminal 1513 (Gnd).

Please refer to FIG. 2, FIG. 3, FIG. 4 and FIG. 5; in which one of two sides of the upper-row plate terminals 151 includes a plurality of upper-row plate contacts, and the other side of the upper-row plate terminals 151 includes a plurality of upper-row plate soldering portions. The upper-row plate contacts are disposed at the upper surface 132*a* to transmit first signals (that is, USB 3.0 signals), and the upper-row plate soldering portions are extended out of a bottom of the base portion 131; furthermore, the upper-row plate soldering portions are bent horizontally and provided as SMT pins, as shown in FIG. 2.

Please refer to FIG. 2, FIG. 3, FIG. 4 and FIG. 5; in which the lower-row plate terminals 152 are disposed at the base portion 131 and the tongue portion 132. The lower-row plate terminals include a plurality of lower-row plate signal terminals 1521, at least one lower-row plate power-supply terminal 1522 and at least one lower-row plate ground terminal 1523. Each of the lower-row plate terminals 152 is disposed at the base portion 131 and the tongue portion 132, and located at the lower surface 132*b*. With a front view of the lower-row plate terminals 152, the lower-row plate terminals 152 include, from left to right, a lower-row plate ground terminal 1523 (Gnd), a first pair of differential signal terminals (TX2+−), a second pair of differential signal terminals (D+−), and a third pair of differential signal terminals (RX1+−) of the lower-row plate signal terminals 1521, lower-row plate power-supply terminals 1522 (Power/VBUS) between the three pairs of differential signal terminals, a retain terminal (RFU), (the retain terminal and a configuration channel 2 (CC2) are respectively arranged between the lower-row plate power-supply terminals 1522 and the second pair of differential signal terminals of the lower-row plate signal terminals 1521), and another lower-row plate ground terminal 1523 (Gnd).

Please refer to FIG. 2, FIG. 3, FIG. 4 and FIG. 5 again; in which a plurality of lower-row plate contacts is disposed at one of two sides of the lower-row plate terminals 152, and a plurality of lower-row plate soldering portions is disposed at the other side of the lower-row plate terminals. The lower-row plate contacts are disposed at the lower surface 132*b* to transmit second signals (that is, USB 3.0 signals), and the upper-row plate soldering portions are extended out of the bottom of the base portion 131; furthermore, the upper-row plate soldering portions are bent downwardly and provided as DIP pins, as shown in FIG. 2.

Please refer to FIG. 2, FIG. 3, FIG. 4 and FIG. 5, in which embodiment, the upper-row plate terminals 151 and the lower-row plate terminals 152 are respectively disposed at the upper surface 132*a* and the lower surface 132*b* of the tongue portion 132. Furthermore, the upper-row plate terminals 151 and the lower-row plate terminals 152 are point-symmetrical with a central point of the receptacle cavity 111 as the symmetrical center. Here, point-symmetry means, after the upper-row plate terminals 151 (or the lower-row plate terminals 152) are rotated by 180 degrees with the symmetrical center as the rotating center, the upper-row plate terminals 151 and the lower-row plate terminals 152 are overlapped; that is, the rotated upper-row plate terminals 151 are arranged at the position of the original lower-row plate terminals 152, and the rotated lower-row plate terminals 152 are arranged at the position of the original upper-row plate terminals 151. In other words, the upper-row plate terminals 151 and the lower-row plate terminals 152 are arranged upside down, and the arrangement sequence of the upper-row plate terminals 151 are left-right reversal with respect to the arrangement sequence of the lower-row plate terminals 152. The electrical plug connector 200 is inserted into the interior of the electrical receptacle connector 100 with a forward orientation for transmitting first signals; conversely, the electrical plug connector 200 is inserted into the interior of the electrical receptacle connector 100 with a reverse orientation for transmitting second signals. The specification for transmitting the first signals conforms to those for transmitting the second signals. Based on this, the inserting orientation of the electrical plug connector 200 is not limited, and can be forwarded or reversed, upon plugging into the electrical receptacle connector 100 according to the present invention.

Please refer to FIG. 2, FIG. 3, FIG. 4 and FIG. 5 again; in which embodiment, positions of upper-row plate terminals 151 correspond to those of the lower-row plate terminals 152.

The conductive pieces 16 are disposed at the upper surface 132*a* and the lower surface 132*b* of the tongue portion 132; from a front view, the conductive pieces 16 are reversed U-profiled elongated sheets symmetrical to one another. Each of the conductive pieces 16 is respectively disposed at an upper surface or a lower surface of the rear contact region 1322 of the tongue portion 132, and two laterally soldering portion 162 of each of the conductive piece 16 are welded with each other to position the conductive piece 16. Each of the conductive pieces includes a contact portion 161, the two laterally soldering portions 162 and an abutting portion 163. The contact portions 161 is a plurality of horizontal sheets and disposed at the rear contact region 1322; the two laterally soldering portions 162 are respectively extending from two sides of the contact portion 161 and welded to each other; the contact portion 161 is perpendicular to the two laterally soldering portions 162; the abutting portion 163 is extending from the contact portion 161 and perpendicular to the contact portion 161; the abutting portion 163 extends upwardly while and the two laterally soldering portions 162 extend downwardly. The abutting portion 163 described herein is attached to the base portion 131 to abut against an inner wall of the metal shell 11, and but the embodiment is not thus limited. In some embodiments, a distance can also be reserved between the abutting portions 163 and the base portion 131; alternatively, the abutting portions 163 can be received in a body of the base portion 131 during insert molding of the base portion 131. Furthermore, the top of the abutting portions 163 is extending from the inner wall of the metal shell 11. The conductive pieces 16 described herein is further provided with a guiding inclined plane 164 extending from one side of the contact portion 161 where the one side of the contact portion 161 is opposite to the abutting portion 163, and the guiding inclined plane 164 is located at a front side of the contact portion 161 and provided for guiding the electrical plug connector 200 to be plugged with the electrical receptacle connector 100. Furthermore, the abutting portion 163 further defines at least one soldering region welded with the metal shell 11, so that the abutting portion 163 is connected with the metal shell 11 via soldering techniques.

In the embodiment, the abutting portions 163 is further provided with a plurality of soldering segments 1631, and the soldering segments 1631 form a plurality of horizontal sheets attached to the inner wall at the upper part and the lower part of the metal shell 11 in parallel. The inner wall of the metal shell 11 can be connected with the soldering segments 1631 by soldering the outer wall face of the metal shell 11. In other words, a plurality of corresponding connection points is formed between the metal shell 11 and the soldering segments 1631, but the embodiment is not thus limited. In some embodiments, the soldering segments 1631 can be provided with a plurality of convex hull structures abutting the inner wall of the metal shell 11 to be connected with the metal shell 11; alternatively, the metal shell 11 can be provided with the convex hull which are located at the inner wall of the metal shell 11 and abuts against the soldering segments 1631 to be connected with the conductive pieces 16.

In the embodiment, the tongue portion 132 is further provided with a plurality of partition blocks 133 disposed at the rear contact region 1322. The partition blocks 133 are disposed at the two sides of the tongue portion 132 and protruded outwardly; the partition blocks 133 are respectively attached to of the two laterally soldering portions 162. In other words, the two laterally soldering portions 162 are fixed between the partition blocks 133 and the base portion 131, thereby positioning the conductive pieces 16 steadily when the electrical receptacle connector 100 is plugged with the electrical plug connector 200.

Figure 6:
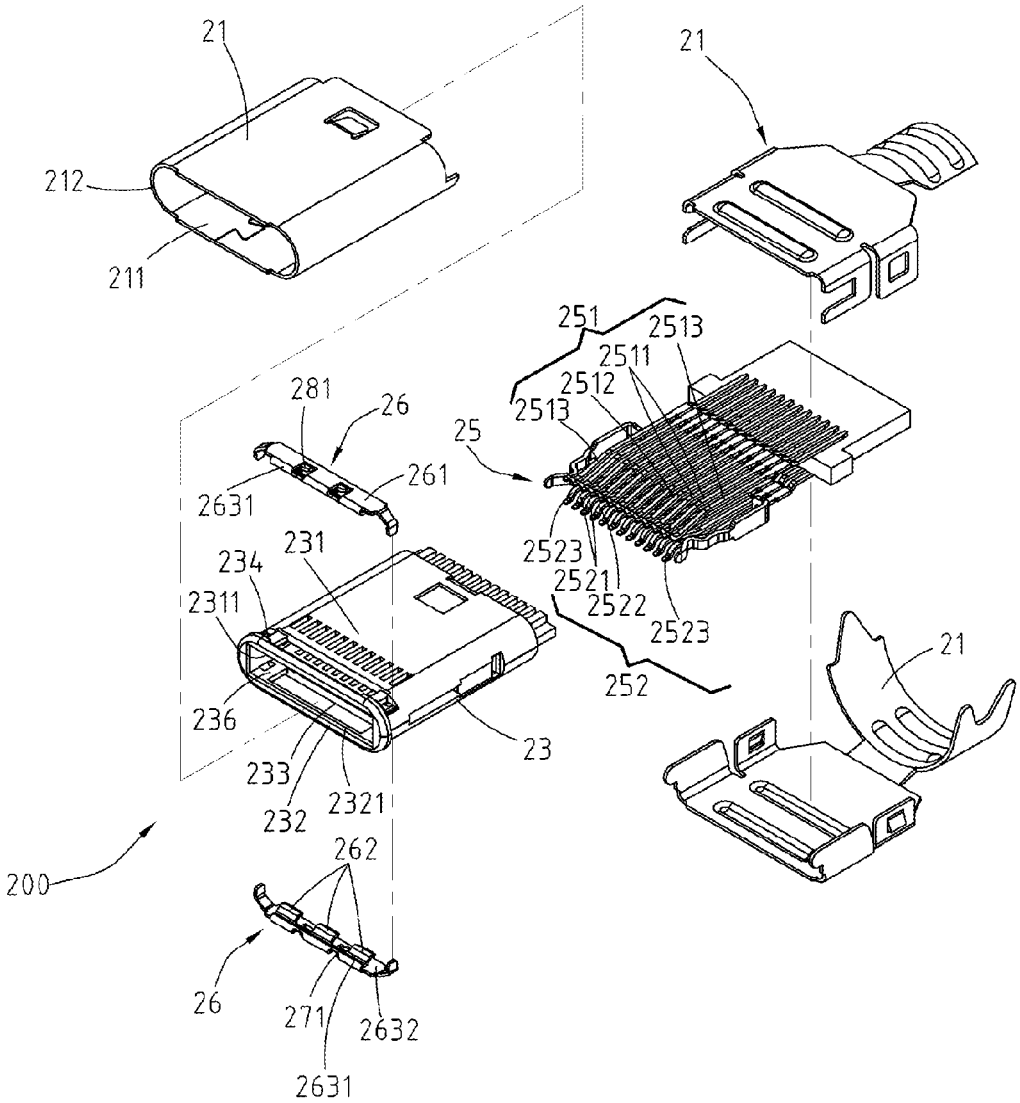
FIG. 6 is an exploded view of an electrical plug connector according to the present invention.
Figure 7:
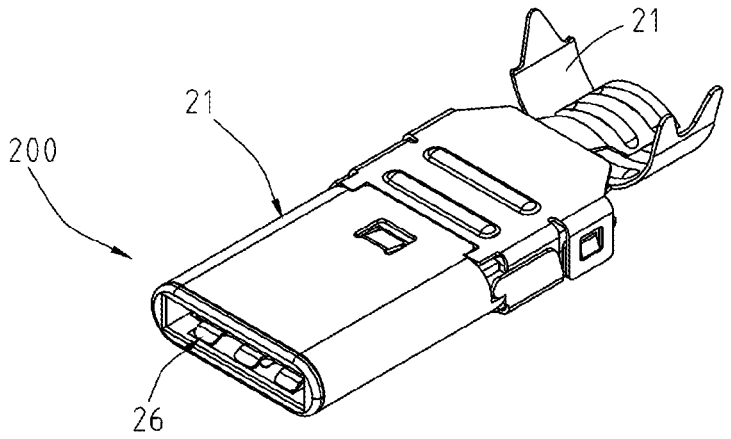
FIG. 7 is a perspective view of the electrical plug connector according to the present invention.

Referring to FIGS. 3, 6 and 7, the electrical plug connector 200 is plugged into the electrical receptacle connector 100, is in accordance with the specification of the type-C USB connection interface and mainly includes a metal shell 21, an insulation housing 23 and a plurality of plug terminals 25 and a plurality of abutting pieces 26.

The metal shell 21 is a hollow shell, and a plug cavity 211 is defined in the metal shell 21; in the embodiment, the metal shell 21 can be formed by a unitary or multi-piece member. Furthermore, the metal shell 21 defines a connection opening 212 in the shape of, for example, oblong or rectangular connection opening 212 and communicates with the plug cavity 211 of the metal shell 21.

The insulation housing 23 is received in the plug cavity 211 and mainly includes an upper portion 231, a lower portion 232 and a terminal groove 236. The upper portion 231 and the lower portion 231 described herein are formed by insert molding techniques, and the terminal groove 236 is defined between the upper portion 231 and the lower portion 231. Moreover, two through grooves 233, respectively defined at on the upper portion 231 and the lower portion 232, are adjacent to the connection opening 212 and communicate with the terminal groove 236. Furthermore, the upper portion 231 includes a lower surface 2311, and the lower portion 232 includes an upper surface 2321, and the lower surface 2311 of the upper portion 231 corresponds to the upper surface 2321 of the lower portion 232.

The plug terminals 25 are disposed at the upper portion 231 and the lower portion 232 and include a plurality of upper-row elastic terminals 251 and a plurality of lower-row elastic terminals 252.

Please refer to FIG. 2, FIG. 3 and FIG. 6, in which the upper-row elastic terminals 251 is disposed at the insulation housing 23 and located at the lower surface 2311 of the upper portion 231. The upper-row elastic terminals 251 include a plurality of upper-row elastic signal terminals 2511, at least one upper-row elastic power-supply terminal 2512 and at least one upper-row elastic ground terminal 2513, and each of the upper-row elastic terminals 251 is disposed at the insulation housing 23 and located at the lower surface 2311 of the upper portion 231. With a front view of the upper-row elastic terminals 251, the upper-row elastic terminals 251 includes, from left to right, an upper-row elastic ground terminal 2513 (Gnd), a first pair of differential signal terminals (TX1+−), a second pair of differential signal terminals (D+−), and a third pair of differential signal terminals (RX2+−) of the upper-row elastic signal terminals 2511, upper-row elastic power-supply terminals 2512 (Power/VBUS) between the three pairs of differential signal terminals, a retain terminal (RFU), (the retain terminal and a configuration channel 1 (CC1) are respectively arranged between the upper-row elastic power-supply terminals 2512 and the second pair of differential signal terminals of the upper-row elastic signal terminals 2511), and another upper-row elastic ground terminal 1523 (Gnd).

Please refer to FIG. 2, FIG. 3 and FIG. 6 again; in which a plurality of upper-row elastic contacts is disposed at one of two sides of the upper-row elastic terminals 251, and a plurality of upper-row elastic soldering portions is disposed at the other side of the upper-row elastic terminals 251. The upper-row elastic contacts are extending from the terminal groove 236 for transmitting first signals (that is, USB 3.0 signals), while the upper-row elastic soldering portions are extending from the rear part of the insulation housing 23, and the upper-row elastic soldering portions are provided to be aligned horizontally, as shown in FIG. 6.

Please refer to FIG. 2, FIG. 3 and FIG. 6, in which the lower-row elastic terminals 252 are disposed at the insulation housing 23 and located at the upper surface 2321 of the lower portion 232. The lower-row elastic terminals 252 includes a plurality of lower-row elastic signal terminals 2521, at least one lower-row elastic power-supply terminal 2522 and at least one lower-row elastic ground terminal 2523, and each of the lower-row elastic terminals 252 is disposed at the insulation housing 23 and located at the upper surface 2321 of the lower portion 232. With a front view of the lower-row elastic terminals 252, the lower-row elastic terminals 252 includes, from left to right, a lower-row elastic ground terminal 2523 (Gnd), a first pair of differential signal terminals (TX2+−), a second pair of differential signal terminals (D+−), and a third pair of differential signal terminals (RX1+−) of the lower-row elastic signal terminals 2521, lower-row elastic power-supply terminals 2522 (Power/VBUS) between the three pairs of differential signal terminals, a retain terminal (RFU), (the retain terminal and a configuration channel 2 (CC2) are respectively arranged between the lower-row elastic power-supply terminals 2522 and the second pair of differential signal terminals of the lower-row elastic signal terminals 2521), and another lower-row elastic ground terminal 2523 (Gnd).

Please refer to FIG. 2, FIG. 3 and FIG. 6 again; in which a plurality of lower-row elastic contacts is disposed at one of two sides of the lower-row elastic terminals 252, and a plurality of lower-row elastic soldering portions is disposed at the other side of the lower-row elastic terminals 252. The lower-row elastic contacts are extending from the terminal groove 236 for transmitting second signals (that is, USB 3.0 signals), while the lower-row elastic soldering portions are extending from the rear part of the insulation housing 23, and the lower-row elastic soldering portions are provided to be aligned horizontally, as shown in FIG. 6.

Please refer to FIG. 2, FIG. 3 and FIG. 6 again, in which embodiment, the upper-row elastic terminals 251 and the lower-row elastic terminals 252 are respectively disposed at the lower surface 2311 of the upper portion 231 and the upper surface 2321 of the lower portion 132. Furthermore, the upper-row elastic terminals 251 and the lower-row elastic terminals 252 are point-symmetrical with a central point of the plug cavity 211 as the symmetrical center. Here, point-symmetry means, after the upper-row elastic terminals 251 (or the lower-row elastic terminals 252) are rotated by 180 degrees with the symmetrical center as the rotating center, the upper-row elastic terminals 251 and the lower-row elastic terminals 252 are overlapped; that is, the rotated upper-row elastic terminals 251 are arranged at the position of the original lower-row elastic terminals 252, and the rotated lower-row elastic terminals 252 are arranged at the position of the original upper-row elastic terminals 251. In other words, the upper-row elastic terminals 251 and the lower-row elastic terminals 252 are arranged upside down, and the arrangement sequence of the upper-row elastic terminals 251 are left-right reversal with respect to the arrangement sequence of the lower-row elastic terminals 252. The electrical plug connector 200 is inserted into the interior of the electrical receptacle connector 100 with a forward orientation for transmitting first signals; conversely, the electrical plug connector 200 is inserted into the interior of the electrical receptacle connector 100 with a reverse orientation for transmitting second signals. The specification for transmitting the first signals conforms to that for transmitting the second signals. Based on this, the inserting orientation of the electrical plug connector 200 is not limited, and can be forwarded or reversed, upon plugging into the electrical receptacle connector 100 according to the present invention.

Please refer to FIG. 2 FIG. 3 and FIG. 6 again; in which embodiment, positions of upper-row elastic terminals 251 correspond to those of the lower-row elastic terminals 252.

The abutting pieces 26 are disposed at the portions 231; the abutting pieces are elongated sheets symmetrical to one another. From a sectional view, the abutting pieces 26 are V-shaped clamping portions. Each of the abutting pieces 26 mainly includes a body portion 261 and at least one bent contact 262. The body portion 261 is a horizontal sheet received in the through groove 233, and the bent contact 262 is connected to the body portion 261, extends into the terminal groove 236 from the through groove 233 and is adjacent to the connection opening 212.

Figure 11:
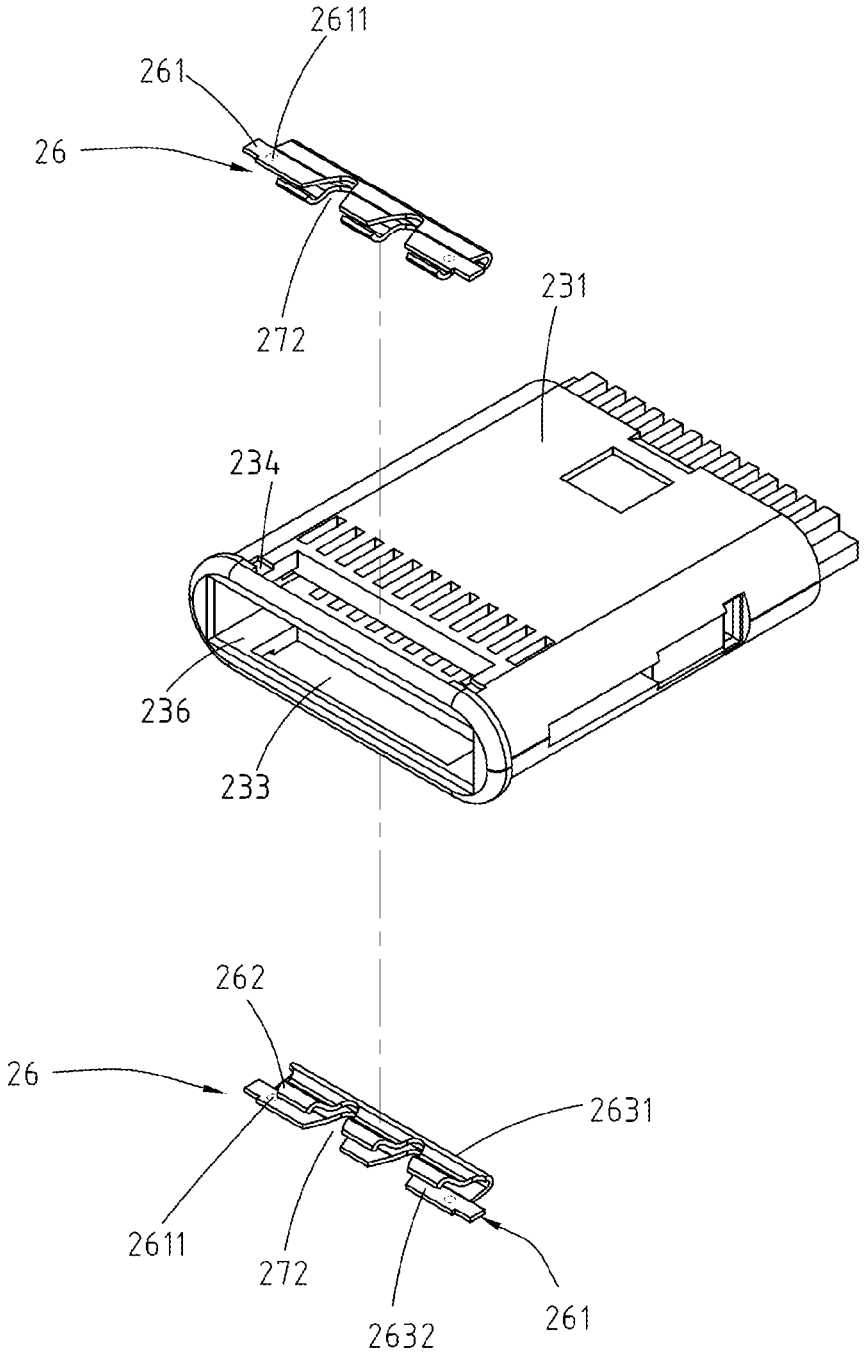
FIG. 11 is an exploded view of a second abutting piece of the electrical plug connector according to the present invention.
Figure 12:
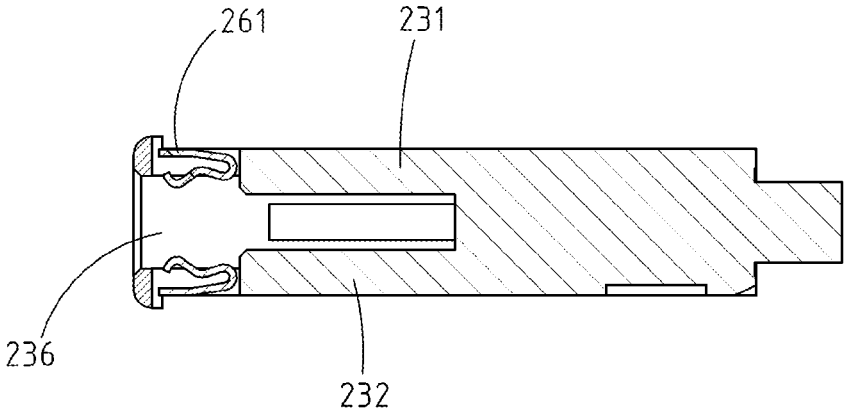
FIG. 12 is a lateral view of the second abutting piece of the electrical plug connector according to the present invention.

Referring to FIGS. 2 and 6, each of the abutting pieces 26 is further provided with at least one bent portion 2631 and at least one elastic space 2632, where one of two ends of the bent portion 2631 is connected to the body portion 261, the other end of the bent portion 2631 is connected to the bent contacts 262; the elastic space 2632 is defined between the body portion 261 and the bent contact 262, and faces toward an interior of the terminal groove 236. In other words, the bent contact 262 extends toward the interior of the terminal groove 236 so as to form a structural configuration where the bent portion 2631 is in a front position (adjacent to the connection opening 212) and the bent contacts 262 is in a rear position, with respect to the inserting orientation of the electrical plug connector 200. That is, the elastic space 2632 communicates with the terminal groove 236 or faces toward the connection opening 212. When plugged into the electrical receptacle connector 100, the electrical receptacle connector 100 forwardly abuts against the bent contact 262 so that the bent contact 262 swings counterclockwise using the respective bent portion 2631 as a swinging center. Note that, here, the electrical receptacle connector 100 forwardly abuts against the bent contacts 262 of the electrical plug connector 200 means, the electrical receptacle connector 100 is approached to the electrical plug connector 200 with a direction opposite to the opening of the elastic space 2632. In some embodiments, the elastic space 2632 can also face toward the connection opening 212 (as shown in FIGS. 11 and 12). In other words, the bent contacts 262 are extending toward the connection opening 212 to form a structural configuration where the bent portion 2631 is in a front position and the bent contacts 262 is in a rear position (adjacent to the connection opening 212), with respect to the inserting orientation of the electrical plug connector 200. When plugged into the electrical receptacle connector 100, the electrical receptacle connector 100 backwardly abuts against the bent contact 262 so that the bent contact 262 swings counterclockwise using the respective bent portion 2631 as a swinging center. Note that, here, the electrical receptacle connector 100 backwardly abuts against the bent contacts 262 of the electrical plug connector 200 means, the electrical receptacle connector 100 is approached to the electrical plug connector 200 with a direction toward the opening of the elastic space 2632.

Figure 13:
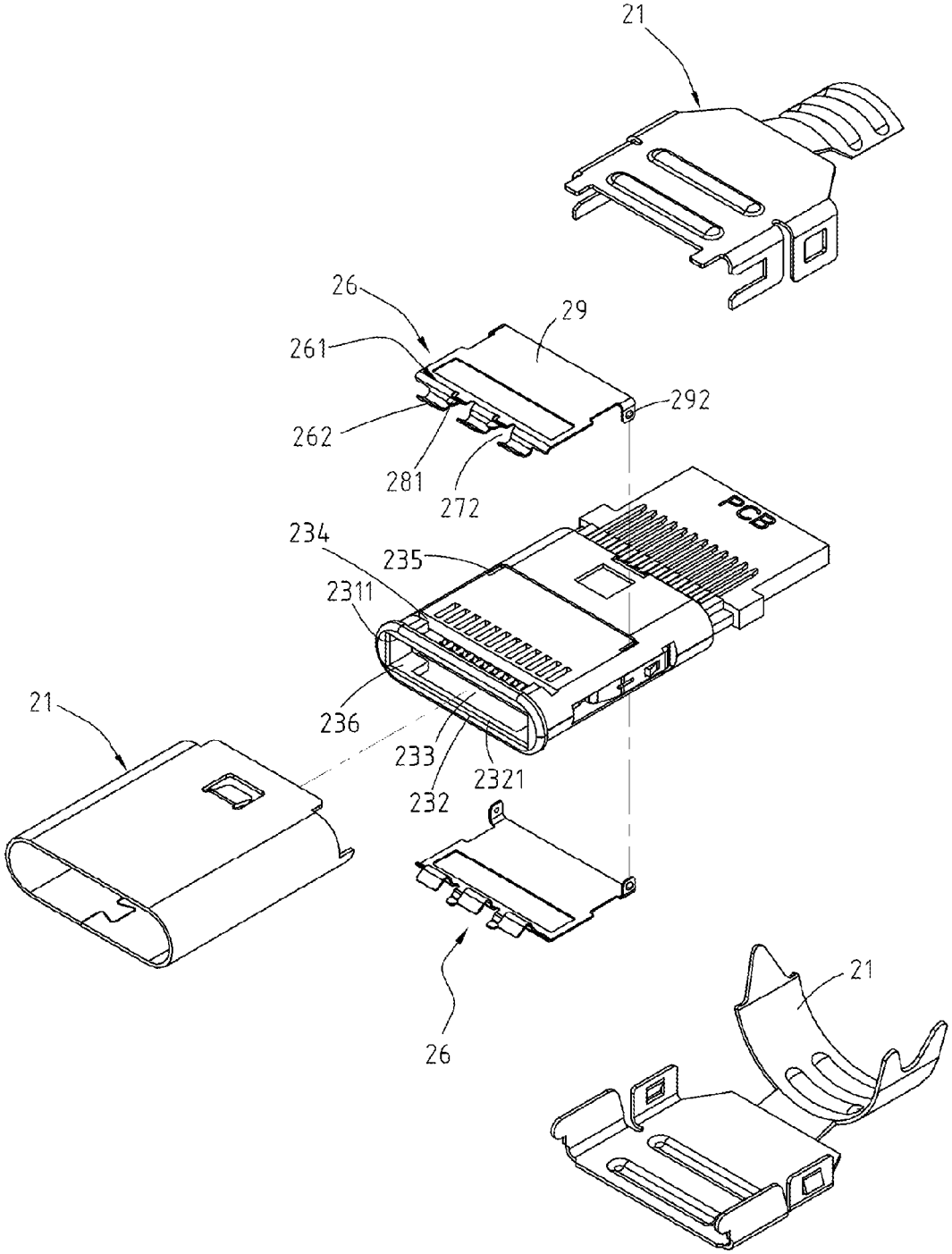
FIG. 13 is an exploded view of a third abutting piece of the electrical plug connector according to the present invention.
Figure 14:
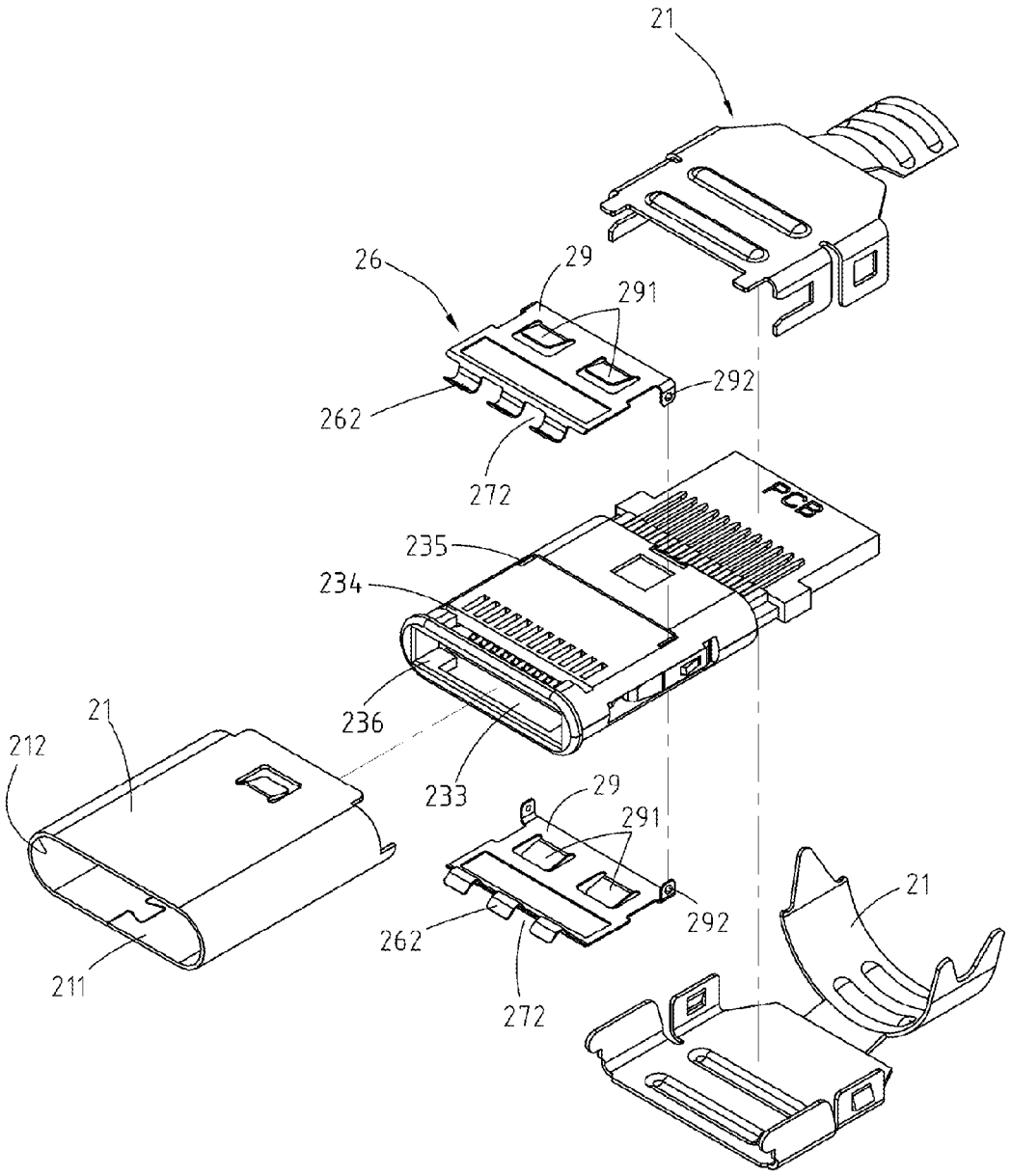
FIG. 14 is another exploded view of the third abutting piece of the electrical plug connector according to the present invention.

An example that the abutting piece 26 is provided with the bent portion 2631 and the elastic space 2632 is only for illustrative purpose. In some embodiments, the bent contact 262 of the abutting piece 26 can be directly formed on the body portion 261 by extending one side of the body portion 261 (as shown in FIGS. 13 and 14), and extends into the terminal groove 236 from the through groove 233. When the electrical plug connector 200 is plugged into the electrical receptacle connector 100, the bent contact 262 is connected to the contact portion 161 of the conductive piece 16.

Referring to FIGS. 2 and 3, when the electrical plug connector 200 is plugged into the electrical receptacle connector 100, the abutting pieces 26 of the electrical plug connector 200 can be connected to the conductive piece 16 of the electrical receptacle connector 100 and the abutting pieces are connected with the metal shell 21 via the body portions 261 thereof, and the conductive piece 16 is connected with the metal shell 11 via the abutting portion 163 so that effective conducting and grounding are achieved between the metal shell 21 of the electrical plug connector 200 and the metal shell 11 of the electrical receptacle connector 100 due to the connection between the abutting pieces 26 and the conductive piece 16, thereby reducing the EMI.

Figure 8:
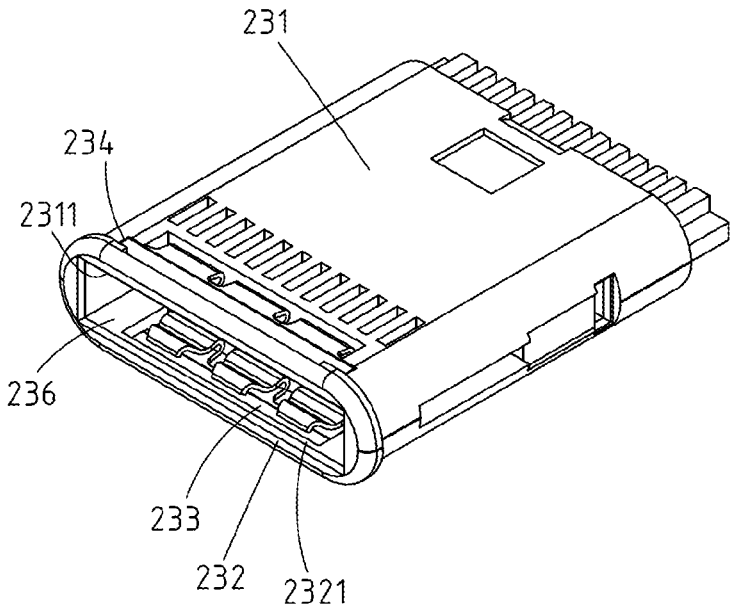
FIG. 8 is a perspective view of an abutting piece of the electrical plug connector according to the present invention.
Figure 9:
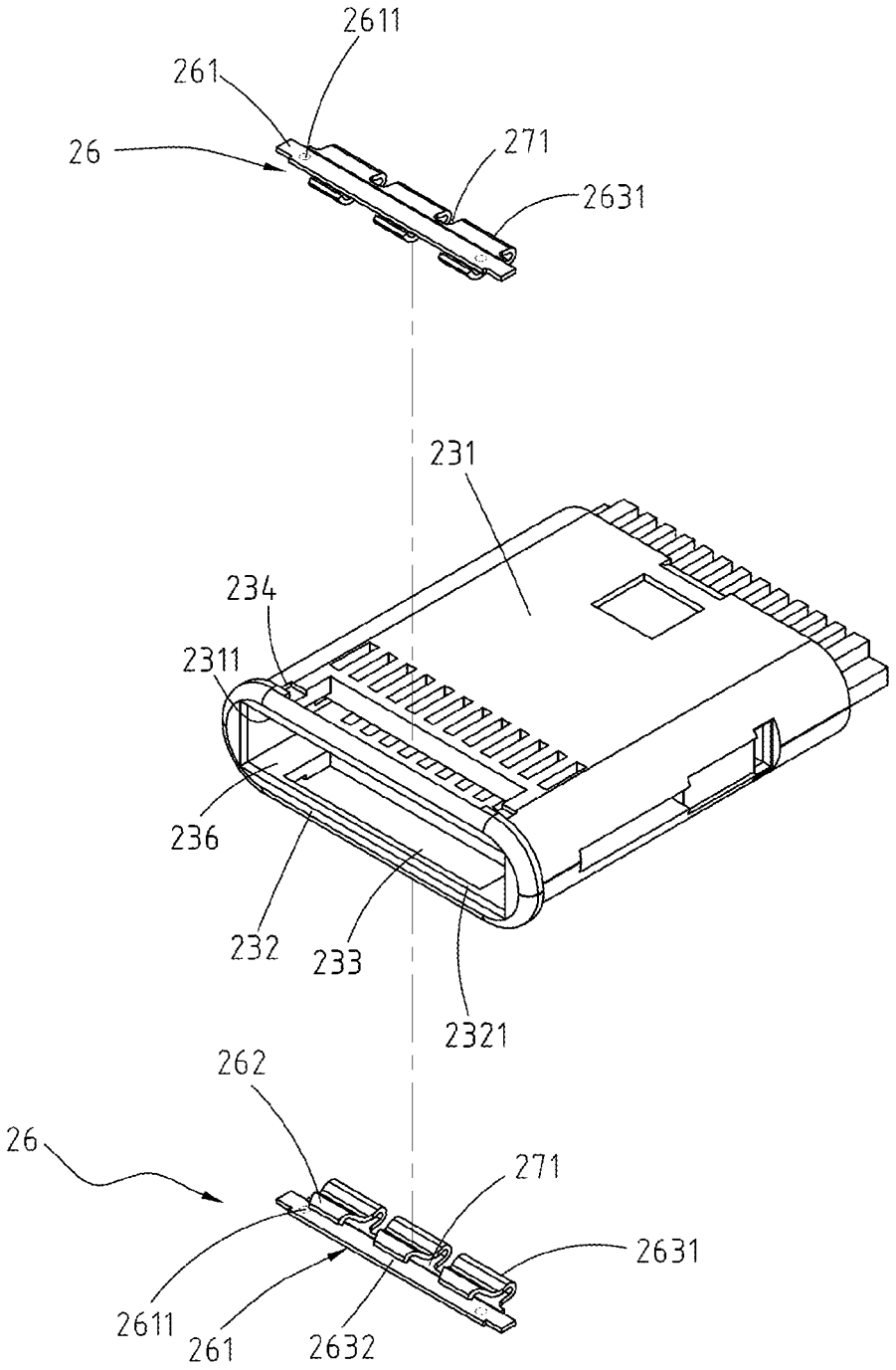
FIG. 9 is an exploded view of the abutting piece of the electrical plug connector according to the present invention.

Referring to FIGS. 6, 8, and 9, in which embodiment, the abutting pieces 26 are further provided with at least one first cutout area 271 defined at the bent portion 2631 and the bent contact 262. In this embodiment, numbers of the first cutout area 271, the bent portion 2631, and the bent contact 262 are plural, and the first cutout areas 271 are defined distantly with respect to each other. In other words, plural bent portions 2631 and plural bent contacts 262 are distantly disposed on a single abutting piece 26, respectively, with the first cutout areas 271 being the spacing between the bent portions 2631 or between the bent contacts 262, and the body portion 261 is provided for connecting the bent portions 2631 and the bent contacts 262. Furthermore, areas of the first cutout areas 271 defined at the bent portions 2631 are rectangular shaped, while areas of the first cutout areas 271 defined at the bent contacts 262 are trapezoid shaped; the areas of the first cutout areas 271 defined at the bent portions 2631 are smaller than that of the first cutout areas 271 defined at the bent contacts 262. When the electrical plug connector 200 is plugged into the electrical receptacle connector 100, the electrical receptacle connector 100 can be in contact with the abutting pieces 26, as shown in FIG. 3. The conductive piece 16 may provide the increased resistance when the electrical receptacle connector 100 is mated with the electrical plug connector 200. In order to accommodate end users with the attribute of usability, durability, and robustness of USB connectors and also to meet the requirement of the connector insertion force lower than extraction force when inserting a plug connector into a receptacle connector or extracting a plug connector from a receptacle connector, the amount of resistance between the metal shell 21 of the electrical plug connector 200 and the conductive piece 16 can be reduced through reducing the contact areas between the surfaces of the metal shell 21 of the electrical plug connector 200 and the conductive piece 16 when in contact. In addition, the amount of resistance between the metal shell 21 of the electrical plug connector 200 and the conductive piece 16 can be controlled through the geometry, material selection, surface finishing and sizing of the conductive piece 16.

Figure 10:
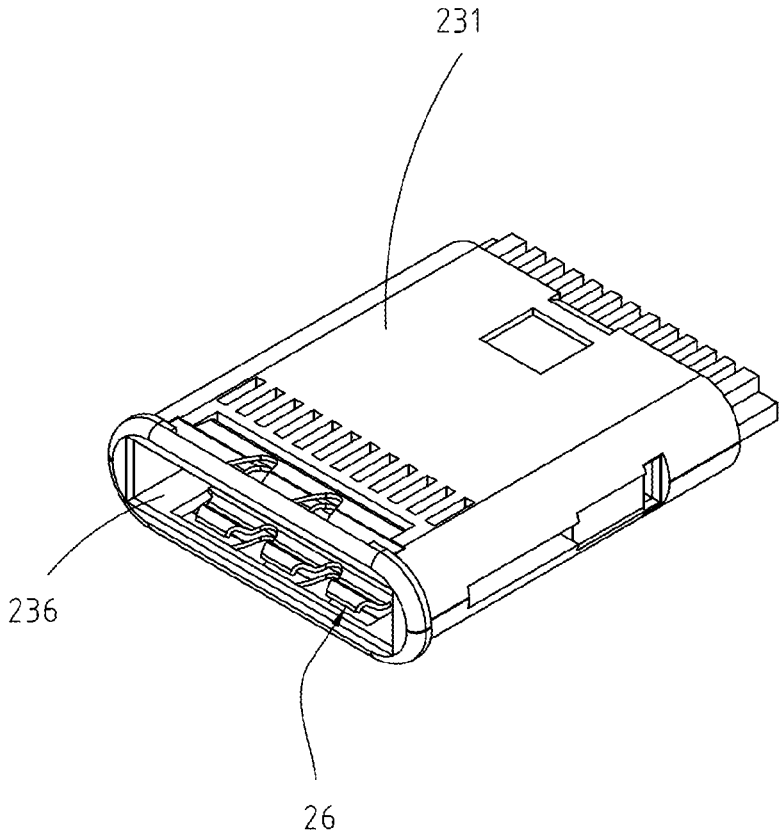
FIG. 10 is a perspective view of another abutting piece of the electrical plug connector according to the present invention.

An example that the abutting pieces 26 are provided with the first cutout areas 271 is only for illustrative purposes. In some embodiments, the abutting pieces 26 are further provided with at least one second cutout areas 272 (shown in FIGS. 10 and 11). In this embodiment, number of the second cutout area 272, the bent portion 2631, the body portion and the bent contact 262 are plural, and the second cutout areas 272 are defined at the body portion 261 and the bent contacts 262, but the embodiment is not thus limited. In some embodiments, the second cutout areas 272 can also only be defined at the bent contacts 262 (shown in FIGS. 13 and 14).

The second cutout areas 272 described herein are defined distantly with respect to each other. In other words, plural body portions 261 and plural bent contacts 262 are distantly disposed on a single abutting piece 26, respectively, with the second cutout areas 272 being the spacing between the body portions 261 or between the bent contacts 262, and the bent portions 2631 are provided for connecting the body portions 261 and the bent contacts 262. Furthermore, areas of the second cutout areas 272 are approximately trapezoid shaped, but the embodiment is not thus limited; areas of the second cutout areas 272 can also be approximately rectangular shaped (shown in FIG. 14). When the electrical plug connector 200 is plugged into the electrical receptacle connector 100, the conductive pieces 16 of the electrical receptacle connector 100 can be in contact with the abutting pieces 26 (shown in FIG. 3). The conductive piece 16 may provide the increased resistance when the electrical receptacle connector 100 is mated with the electrical plug connector 200. In order to accommodate end users with the attribute of usability, durability, and robustness of USB connectors and also to meet the requirement of the connector insertion force lower than extraction force when inserting a plug connector into a receptacle connector or extracting a plug connector from a receptacle connector, the amount of resistance between the metal shell 21 of the electrical plug connector 200 and the conductive piece 16 can be reduced through reducing the contact areas between the surfaces of the metal shell 21 of the electrical plug connector 200 and the conductive piece 16 when in contact. In addition, the amount of resistance between the metal shell 21 of the electrical plug connector 200 and the conductive piece 16 can be controlled through the geometry, material selection, surface finishing and sizing of the conductive piece 16. Furthermore, areas of the second cutout areas 272 are larger than that of the first cutout areas 271, and the resistance force of the abutting pieces 26 provided with the second cutout areas 272 is smaller than that of the abutting pieces 26 provided with the first cutout areas 271.

Referring to FIGS. 8, 9, and 11, in which each of the body portions 261 is further provided with at least one soldering contact 2611 welded with the metal shell 21. The inner wall of the metal shell 21 can be welded with the body portion 261 by soldering the outer wall of the metal shell 21, so that the soldering contact 2611 is formed on the body portion 261, but the embodiment is not thus limited. In some embodiments, the soldering contact 2611 can form convex hull structures abutting against the inner wall of the metal shell 21 to connect with the metal shell 21, alternatively, the inner wall of the metal shell 21 can be provided with the convex hull structures abutting against the body portion 261.

An example that the soldering contact 2611 of the body portion 261 is connected with the metal shell 21 is only for illustrative purposes. In some embodiments, each of the abutting pieces 26 is further provided with a plurality of first extension portions 281 (shown in FIGS. 6 and 13), and the first extension portions 281 are extending from the body portion 261 to abut against the metal shell 21, respectively. In this embodiment, the first extension portions 281 are extending upwardly and inclinedly from the body portions 261, respectively. When metal shell 21 covers the insulation housing 23, the inner wall of the metal shell 21 is connected with the first extension portions 281.

Referring to FIG. 14, in which the electrical plug connector 200 further includes a plurality of fixing portions 29, each of the fixing portions 29 is extending from the body portion 261 to be fixed at surfaces of the upper portion 231 and the lower portion 232 of the insulation housing 23, respectively. Two sides of each of the fixing portions 29 are provided with a plurality of buckling portions 292, and two sides of the insulation housing 23 are provided with via grooves 235, and the buckling portions 292 are respectively combined with the via grooves 235 for fixing the fixing portions 29 on the upper portion 231 and the lower portion 232. Moreover, the each of the fixing portions 29 is further provided with a plurality of second extension portions 291, and the second extension portions 291 is abutted against the inner wall of the metal shell 21, upwardly and inclinedly extending from center portions of the fixing portions 29. When the metal shell 21 covers the insulation housing 23, the inner wall of the metal shell 21 is connected with the second extension portions 291.

Referring to FIGS. 6, 8, 9, and 11, in some embodiments, a plurality of positioning grooves 234 is respectively formed on the upper portion 231 and the lower portion 232, the positioning grooves 234 are respectively disposed at two sides of each of the through grooves 233, and the abutting pieces 26 can be fixed in the positioning grooves 234 and the through grooves 233, so that the two sides of the body portions 261 of the abutting pieces 26 are combined in the positioning grooves 234, respectively.

Since the abutting pieces of the electrical plug connector is connected to the conductive pieces of the electrical receptacle connector, effective conducting and grounding can be achieved between the metal shell of the electrical plug connector and the metal shell of the electrical receptacle connector due to the connection of the abutting pieces and the conductive pieces, and the EMI can be further reduced. The conductive piece may provide the increased resistance when the electrical receptacle connector is mated with the electrical plug connector. In order to accommodate end users with the attribute of usability, durability, and robustness of USB connectors and also to meet the requirement of the connector insertion force lower than extraction force when inserting a plug connector into a receptacle connector or extracting a plug connector from a receptacle connector, the amount of resistance between the metal shell of the electrical plug connector and the conductive piece can be reduced through reducing the contact areas between the surfaces of the metal shell of the electrical plug connector and the conductive piece when in contact. In addition, the amount of resistance between the metal shell of the electrical plug connector and the conductive piece can be controlled through the geometry, material selection, surface finishing and sizing of the conductive piece.

While the disclosure has been described by the way of example and in terms of the preferred embodiments, it is to be understood that the present invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical plug connector, comprising:

a metal shell comprising a plug cavity and a connection opening communicating with the plug cavity;

an insulation housing received in the plug cavity, wherein the insulation housing comprises an upper portion, a lower portion and a terminal groove, the terminal groove is defined between the upper portion and the lower portion, and the upper portion and the lower portion comprise a plurality of through grooves adjacent to the connection opening;

a plurality of upper-row elastic terminals comprising a plurality of upper-row elastic signal terminals, at least one upper-row elastic power-supply terminal and at least one upper-row elastic ground terminal, each of the upper-row elastic terminals disposed at the insulation housing and located at a lower surface of the upper portion;

a plurality of lower-row elastic terminals comprising a plurality of lower-row elastic signal terminals, at least one lower-row elastic power-supply terminal and at least one lower-row elastic ground terminal, each of the lower-row elastic terminals disposed at the insulation housing and located at an upper surface of the lower portion; and a plurality of abutting pieces disposed at the upper portion and the lower portion and connected to the metal shell, wherein each of the abutting pieces comprises:

a body portion received in the through groove; and at least one bent contact extending from the body portion, wherein the bent contact extends into the terminal groove from the through grooves.

2. The electrical plug connector according to claim 1, wherein each of the abutting pieces comprises at least one bent portion bending and extending from one side of the body portion and connected to the bent contact, each of the abutting pieces further comprises at least one elastic space defined between the portion and the bent contact, the elastic space communicates with the terminal groove or faces toward the connection opening.

3. The electrical plug connector according to claim 2, wherein the abutting pieces comprise at least one first cutout areas defined at the bent portion and the bent contact.

4. The electrical plug connector according to claim 2, wherein the abutting pieces comprise at least one second cutout areas defined at the body portions and the bent contacts.

5. The electrical plug connector according to claim 1, wherein each of the body portions further defines at least one soldering contact welded with to the metal shell.

6. The electrical plug connector according to claim 1, wherein each of the abutting pieces comprises a plurality of first extension portions extending from the body portion to abut against an inner wall of the metal shell.

7. The electrical plug connector according to claim 1, further comprising a plurality of fixing portions, each of the fixing portions extending from the body to be fixed at surfaces of the upper portion and the lower portion, respectively.

8. The electrical plug connector according to claim 7, wherein each of the fixing portions comprises a plurality of second extension portions formed thereon to abut against the inner wall of to the metal shell.

9. The electrical plug connector according to claim 1, wherein a plurality of positioning grooves is respectively formed on the upper portion and the lower portion, each of the positioning grooves is located at two sides of the through groove and fixed to two sides of the body portion.

10. The electrical plug connector according to claim 1, wherein the upper-row elastic signal terminals are disposed at the lower surface of the upper portion for transmitting first signals, the lower-row elastic signal terminals are disposed at the upper surface of the lower portion for transmitting second signals, the transmission specifications of the first signals conform to those of the second signals, the upper-row elastic terminals and the lower-row elastic terminals are point-symmetrical with a central point of the plug cavity as the symmetrical center.

11. The electrical plug connector according to claim 2, wherein the upper-row elastic signal terminals are disposed at the lower surface of the upper portion for transmitting first signals, the lower-row elastic signal terminals are disposed at the upper surface of the lower portion for transmitting second signals, the transmission specifications of the first signals conform to those of the second signals, the upper-row elastic terminals and the lower-row elastic terminals are point-symmetrical with a central point of the plug cavity as the symmetrical center.

12. The electrical plug connector according to claim 3, wherein the upper-row elastic signal terminals are disposed at the lower surface of the upper portion for transmitting first signals, the lower-row elastic signal terminals are disposed at the upper surface of the lower portion for transmitting second signals, the transmission specifications of the first signals conform to those of the second signals, the upper-row elastic terminals and the lower-row elastic terminals are point-symmetrical with a central point of the plug cavity as the symmetrical center.

13. The electrical plug connector according to claim 4, wherein the upper-row elastic signal terminals are disposed at the lower surface of the upper portion for transmitting first signals, the lower-row elastic signal terminals are disposed at the upper surface of the lower portion for transmitting second signals, the transmission specifications of the first signals conform to those of the second signals, the upper-row elastic terminals and the lower-row elastic terminals are point-symmetrical with a central point of the plug cavity as the symmetrical center.

14. The electrical plug connector according to claim 5, wherein the upper-row elastic signal terminals are disposed at the lower surface of the upper portion for transmitting first signals, the lower-row elastic signal terminals are disposed at the upper surface of the lower portion for transmitting second signals, the transmission specifications of the first signals conform to those of the second signals, the upper-row elastic terminals and the lower-row elastic terminals are point-symmetrical with a central point of the plug cavity as the symmetrical center.

15. The electrical plug connector according to claim 6, wherein the upper-row elastic signal terminals are disposed at the lower surface of the upper portion for transmitting first signals, the lower-row elastic signal terminals are disposed at the upper surface of the lower portion for transmitting second signals, the transmission specifications of the first signals conform to those of the second signals, the upper-row elastic terminals and the lower-row elastic terminals are point-symmetrical with a central point of the plug cavity as the symmetrical center.

16. The electrical plug connector according to claim 7, wherein the upper-row elastic signal terminals are disposed at the lower surface of the upper portion for transmitting first signals, the lower-row elastic signal terminals are disposed at the upper surface of the lower portion for transmitting second signals, the transmission specifications of the first signals conform to those of the second signals, the upper-row elastic terminals and the lower-row elastic terminals are point-symmetrical with a central point of the plug cavity as the symmetrical center.

17. The electrical plug connector according to claim 8, wherein the upper-row elastic signal terminals are disposed at the lower surface of the upper portion for transmitting first signals, the lower-row elastic signal terminals are disposed at the upper surface of the lower portion for transmitting second signals, the transmission specifications of the first signals conform to those of the second signals, the upper-row elastic terminals and the lower-row elastic terminals are point-symmetrical with a central point of the plug cavity as the symmetrical center.

18. The electrical plug connector according to claim 9, wherein the upper-row elastic signal terminals are disposed at the lower surface of the upper portion for transmitting first signals, the lower-row elastic signal terminals are disposed at the upper surface of the lower portion for transmitting second signals, the transmission specifications of the first signals conform to those of the second signals, the upper-row elastic terminals and the lower-row elastic terminals are point-symmetrical with a central point of the plug cavity as the symmetrical center.

19. The electrical plug connector according to claim 10, wherein positions of the upper-row elastic terminals correspond to those of the lower-row elastic terminals.

* * * * *